US006896430B2

(12) United States Patent
Williams

(10) Patent No.: US 6,896,430 B2
(45) Date of Patent: May 24, 2005

(54) COMPLIANT BELT ATTACH

(75) Inventor: Martin R. Williams, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 11 days.

(21) Appl. No.: 10/278,635

(22) Filed: Oct. 23, 2002

(65) Prior Publication Data

US 2004/0081502 A1 Apr. 29, 2004

(51) Int. Cl.[7] ..... B41J 11/22

(52) U.S. Cl. ..... 400/352; 400/323; 400/354; 474/145; 474/202; 74/833

(58) Field of Search ..... 400/352, 353, 400/354, 355, 323; 474/253, 255, 145, 202, 203, 204; 198/834, 748; 74/833, 892

(56) References Cited

U.S. PATENT DOCUMENTS

| | | | | | |
|---|---|---|---|---|---|
| 4,084,681 | A | | 4/1978 | Heinzl et al. | |
| 4,479,731 | A | | 10/1984 | Kawaguchi | |
| 5,098,209 | A | | 3/1992 | Gomoll et al. | |
| 5,352,029 | A | * | 10/1994 | Nagorcka | 305/199 |
| 5,391,121 | A | * | 2/1995 | Schramm | 474/253 |
| 5,419,744 | A | * | 5/1995 | Kagebeck | 474/253 |
| 5,449,086 | A | * | 9/1995 | Harris | 220/288 |
| 5,465,107 | A | | 11/1995 | Mayo et al. | |
| 5,597,368 | A | * | 1/1997 | Goser et al. | 474/204 |
| 5,778,287 | A | * | 7/1998 | Yu | 399/167 |
| 5,914,736 | A | | 6/1999 | Tamura | |
| 5,964,542 | A | | 10/1999 | Ruhe et al. | |
| 6,045,212 | A | | 4/2000 | Ruhe et al. | |
| 6,305,780 | B1 | | 10/2001 | Askren et al. | |
| 6,309,318 | B1 | * | 10/2001 | Hormann | 474/255 |
| 6,598,956 | B2 | * | 7/2003 | Yusef et al. | 347/37 |
| 6,764,143 | B2 | * | 7/2004 | Peterson et al. | 305/165 |

* cited by examiner

*Primary Examiner*—Andrew H. Hirshfeld
*Assistant Examiner*—David A Ghatt

(57) ABSTRACT

A compliant belt attach assembly for use in a printer includes a belt attach and a drive belt having a drive lug. The belt attach defines a lug chamber for containing the drive lug of the drive belt. First and second drive bars are configured to contact the first and second sides of the drive lug to allow drive lug deformation in response to vibration transmitted by the drive belt.

19 Claims, 8 Drawing Sheets

COMPLIANT BELT ATTACH

BACKGROUND

In some printers, a carriage moves back and forth within an enclosure, allowing a print cartridge to apply ink to media passing through a paper path. The motion of the carriage is controlled by a drive system. Unfortunately, a drive system typically introduces vibration, which often results in print quality degradation. The vibration may come from cogging noises in the motor, bearing noises, belt-to-tooth interaction in the drive pulley or from other sources. Where the vibration is great enough, print quality degradation may result.

In response, compliant belt attach assemblies have been developed. The compliant belt attach assembly functions to connect the drive belt to the carriage and to absorb shock and damp vibration present in the drive system. However, in view of the large number of printer configurations, including differences in carriage design, print cartridge configuration, and other design parameters, a compliant belt attach assembly which is effective and economic on one printer may be ineffective or economically prohibitive on another printer.

SUMMARY

A compliant belt attach assembly for use in a printer includes a belt attach and a drive belt having a drive lug. The belt attach defines a lug chamber for containing the drive lug of the drive belt. First and second drive bars are configured to contact the first and second sides of the drive lug to allow drive lug deformation in response to vibration transmitted by the drive belt.

BRIEF DESCRIPTION OF THE DRAWINGS

The same reference numbers are used throughout the drawings to reference like features and components.

DETAILED DESCRIPTION

Figure 1:
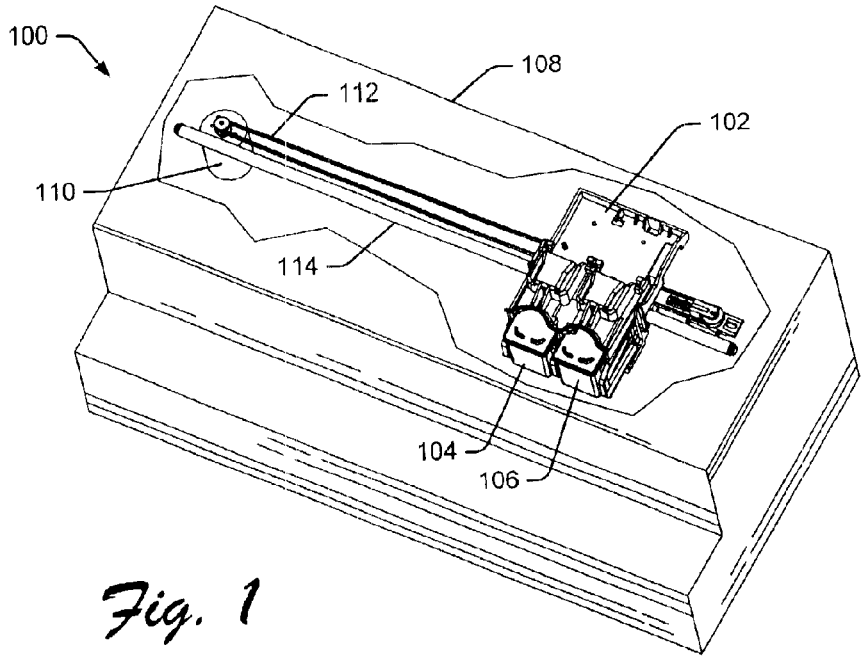
FIG. 1 is an illustration of a printer according to an embodiment of the present invention, showing an upper surface of a carriage supporting black and color print cartridges visible through a cut-out defined on an upper surface of an enclosure.

FIG. 1 is an illustration of a printer 100, showing an upper surface of a carriage 102 supporting a black print cartridge 104 and a color print cartridge 106 visible through a cut-out defined on an upper surface of an enclosure 108. A motor 110 drives a belt 112, which positions the print carriage 102 at any desired position along a carriage rod 114. Accordingly, during operation, the print carriage may be moved back and forth, thereby positioning the black and color print cartridge 104, 106 above any desired location of print media moving through the printer 100.

Figure 2:
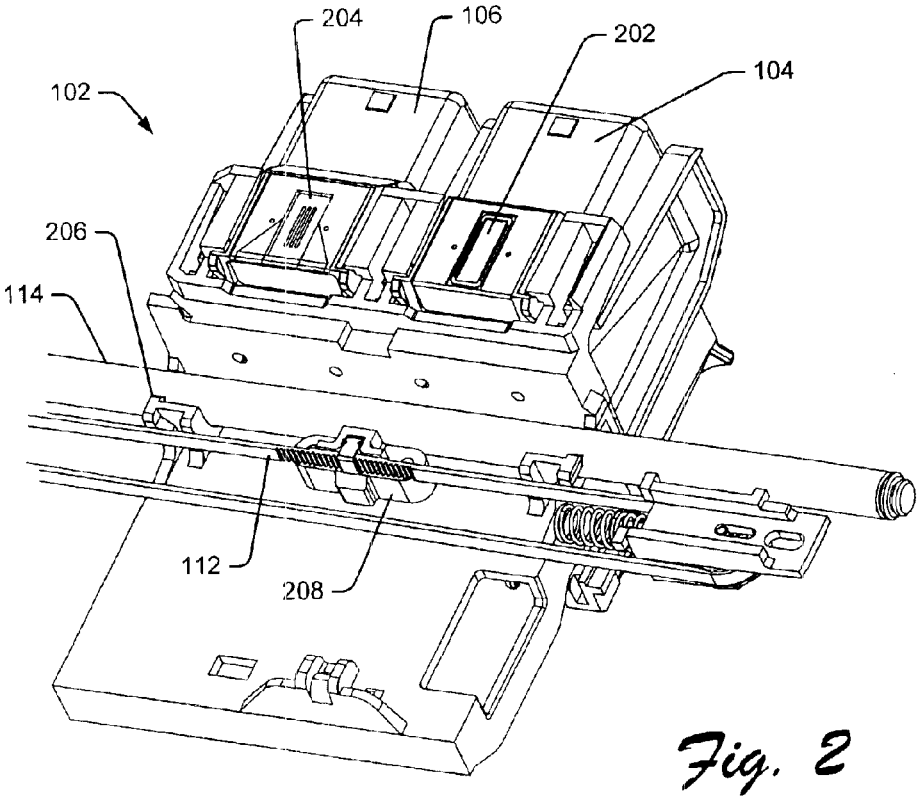
FIG. 2 is an illustration of the lower surface of the carriage seen in FIG. 1, showing the compliant belt attach assembly according to an embodiment of the present invention.

FIG. 2 is an illustration of the lower surface of the carriage 102, showing the nozzle orifice 202 of the black print cartridge 104, and the multiple nozzle orifices 204 of the color print cartridge 106. The carriage rod 114 supports the print carriage 102 using bushings 206 or other support hardware. The belt 112 is attached to a compliant belt attach 208, which in turn is connected to the print carriage 102.

Figure 3A:
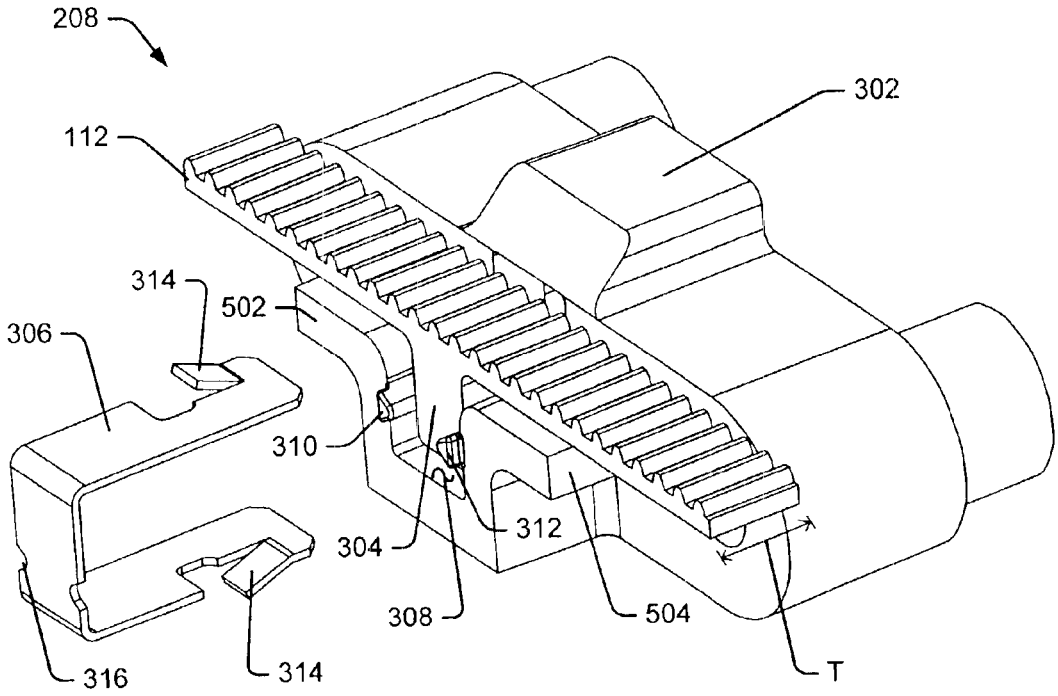
FIGS. 3A and 3B are partially exploded views of two alternative embodiments of the compliant belt attach of FIG. 2.
Figure 3B:
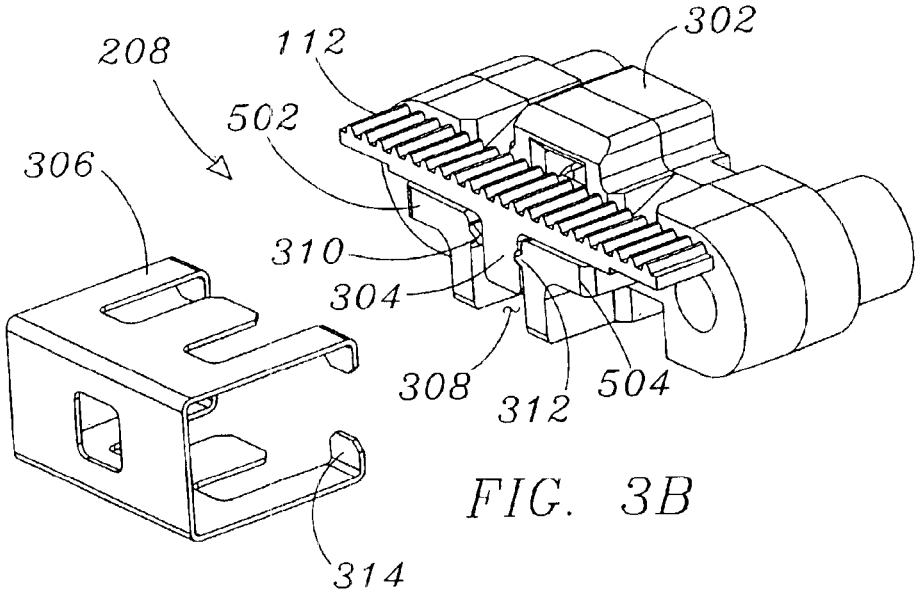

FIGS. 3A and 3B are exploded views of two embodiments of the compliant belt attach assembly 208, separated from the carriage 102. The compliant belt attach assembly 208 includes a belt attach 302, the drive belt 112 having a drive lug 304, and a retaining clip 306. The belt attach 302 defines a lug chamber 308 sized to carry the drive lug 304. As will be discussed in greater detail later, the left and right sides defining the lug chamber 308 form first and second drive bars 310, 312 which are force transfer points on which the drive lug 304 is configured to push. Therefore, movement of the belt 112 moves the drive lug 304. Depending on the direction of drive lug movement, the drive lug 304 applies force to one of the drive bars 310, 312, thereby moving the belt attach 302 and the carriage 102 to which it is attached.

Figure 4A:
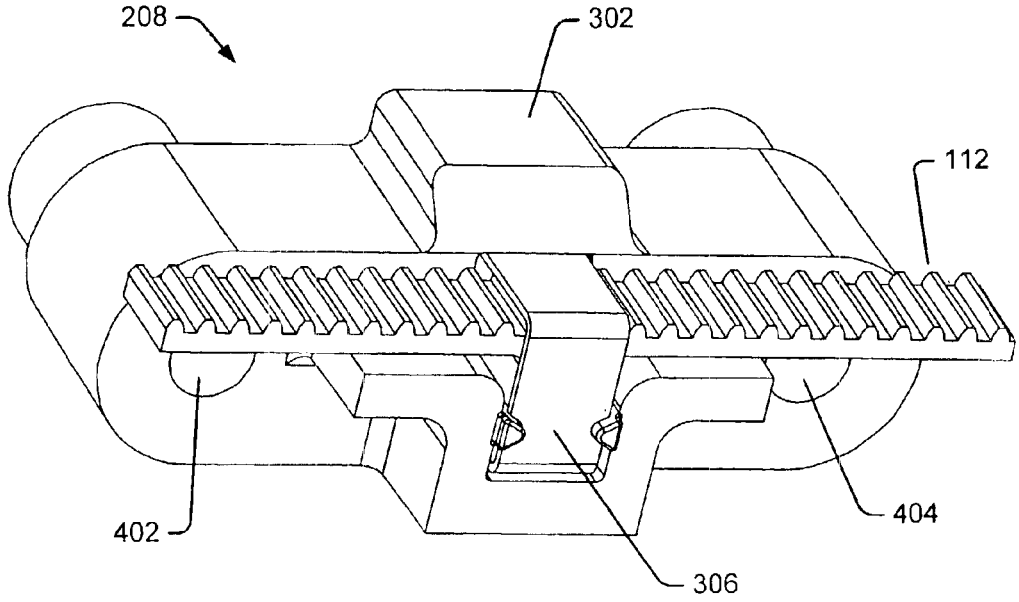
FIGS. 4A and 4B are assembled views of the two embodiments of the compliant belt attach of FIGS. 3A and 3B, respectively.
Figure 4B:
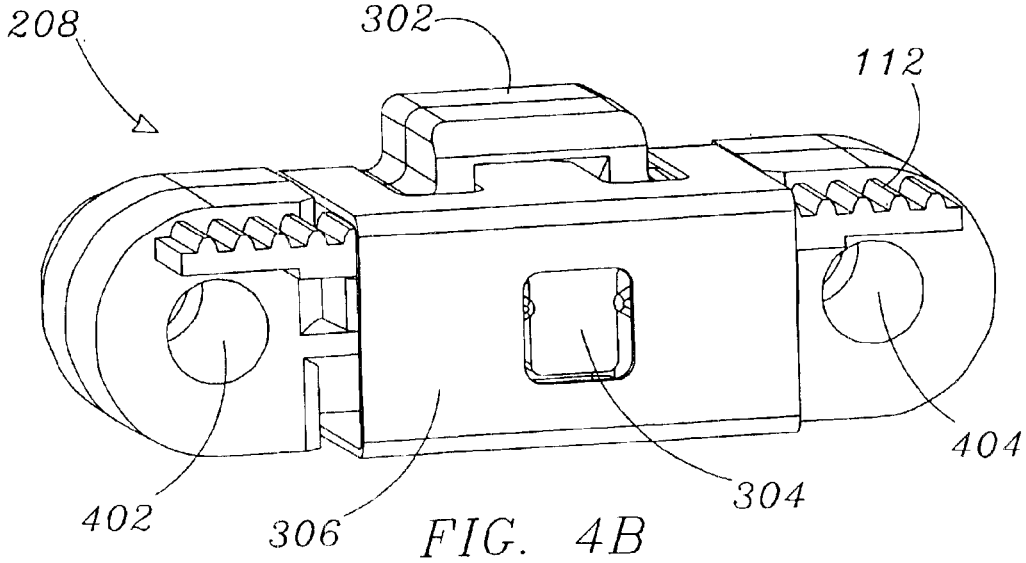

FIGS. 4A and 4B are assembled views of the compliant belt attach assembly 208, showing the belt attach 302 attached to the belt 112 by the retainer clip 306. In the view of FIG. 4A, the drive lug 304 and lug chamber 308 are obscured by the retainer clip 306. A fastener housing defining fastener holes 402 and 404 facilitates connection of the belt attach 302 to the carriage.

The retainer clip 306 is sized and configured to connect the drive lug 304 and the belt attach 302 in a releasable manner. When the retainer clip 306 is installed as seen in FIGS. 4A and 4B, the drive lug 304 is confined within the lug chamber 308 in a manner which does not prevent the movement and flexibility of the drive lug 304. The retainer clip 306 also prevents lifting of the drive belt 112 in the area of the drive lug 304, keeping the drive belt 112 adjacent to the shelves 502, 504. Flexible fastening flanges 314 carried by the retainer clip 306 engage the belt attach 302 in a releasable manner. In the version of the retainer clip 306 seen in FIGS. 3A and 3B, notches 316 defined in the retainer clip 306 fit around the drive bars 310, 312.

Figure 5:
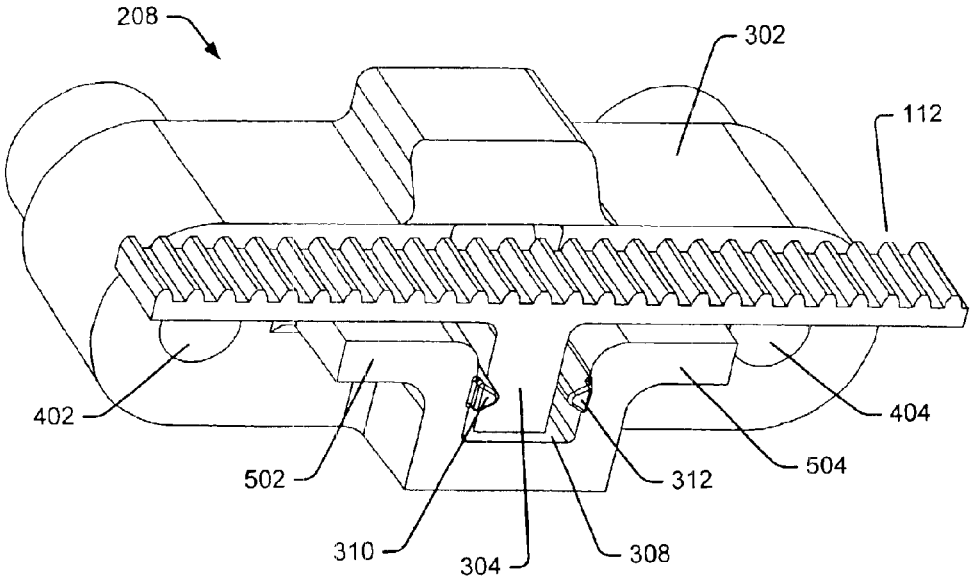
FIG. 5 is a further enlarged view of the compliant belt attach according to the embodiment shown in FIG. 3A.

FIG. 5 is a further enlarged view of the compliant belt attach assembly 208, shown without the retainer clip 306. The drive lug 304 of the drive belt 112 is carried within the drive lug chamber 308 defined in the belt attach 302. The left and right drive bars 310, 312 are positioned to make contact with the left and right sides of the drive lug 304, respectively. Left and right belt support shelves 502, 504 support portions of the drive belt 112 adjacent to the drive lug 304. Accordingly, when the drive lug 304 applies force to one of the drive bars 310, 312 the drive belt will be supported by the support shelves 502, 504 and retainer clip 306, and will therefore maintain a more linear configuration than would otherwise be the case.

Figure 6A:
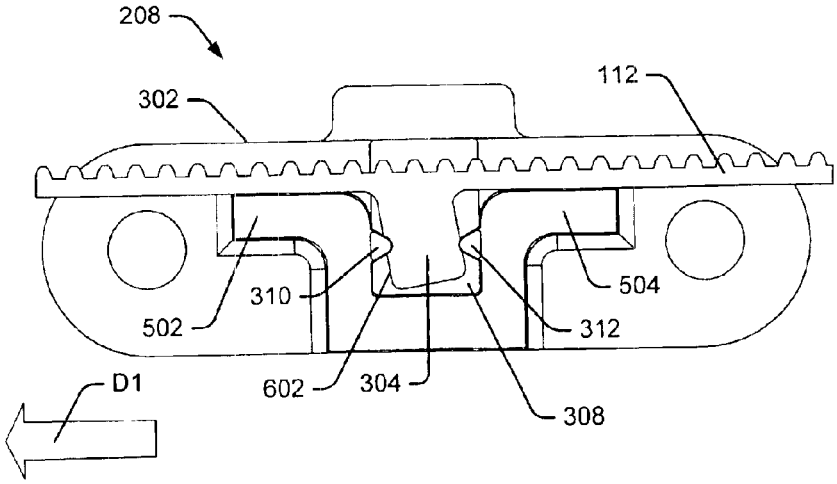
FIGS. 6A–C are three schematic views of the compliant belt attach of FIGS. 3A and 4A flexing in response to different forces according to an embodiment of the present invention.
Figure 6B:
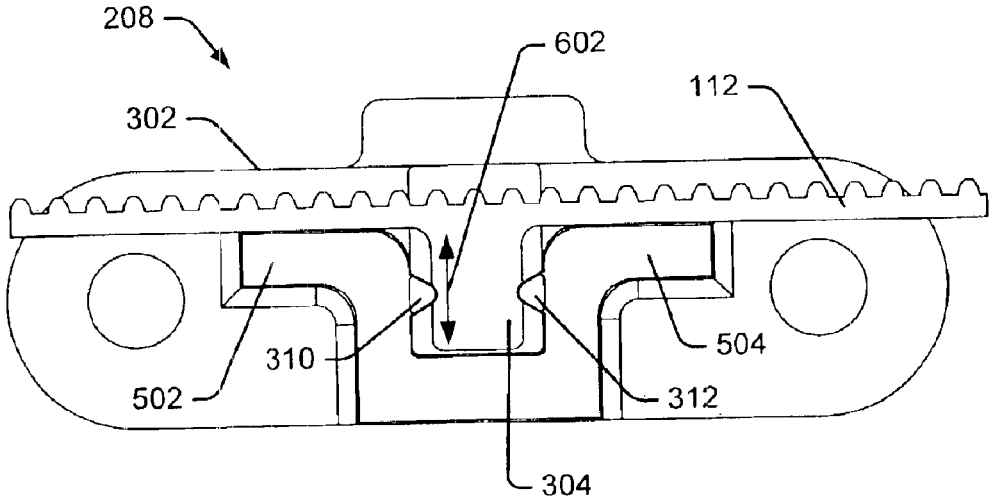
Figure 6C:
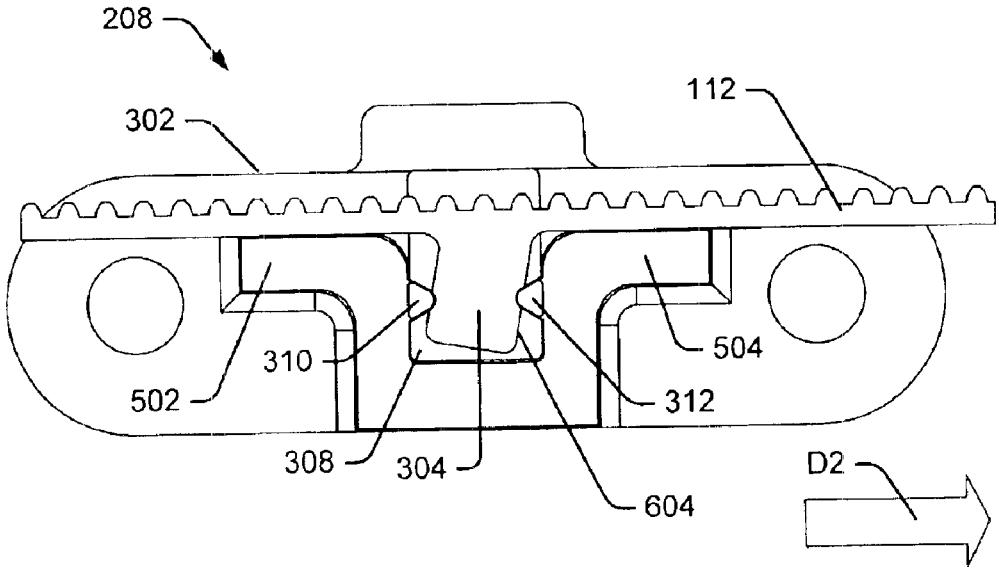

FIGS. 6A-C are three views of drive lug deformation (i.e. flexing of the drive lug 304) in response to unwanted vibration and mechanical noise of different types. FIG. 6A shows a portion of the compliant belt attach assembly 208, including the belt attach 302. In the view of FIG. 6A, the belt attach 302 is shown being moved to the left by movement to the left of the drive belt 112 and shows the resultant deformation of the drive lug 304. Unwanted vibration and/or mechanical noise are filtered out by slight oscillations of the drive lug 304 around this position and by the inherent damping properties of the material from which the drive lug 304 is constructed. The degree to which the drive lug 304 is shown to be deformed is for illustrative purposes, and the deformation could be to a greater or lesser degree depending on the application. The support shelves 502, 504 prevent the drive belt 112 from deforming adjacent to the drive lug 304.

FIG. 6B illustrates the configuration of the drive lug 304 when the drive belt 112 is reversing direction, or the carriage is stopped. Under these conditions, the resilience of the material from which the drive lug 304 is manufactured has removed the deformation seen in FIG. 6A. FIG. 6B also shows the configuration of the drive lug absent noticeable unwanted vibration and noise.

FIG. 6C shows the belt attach 302 being moved to the right by movement to the right of the drive belt 112, and the resultant deformation of the drive lug 304. Unwanted vibration or mechanical noise is filtered out by slight oscillations of the drive lug 304 material and the inherent damping properties of the material from which the drive lug 304 is constructed. As before, the support shelves 502, 504 have prevented the drive belt 112 from deforming adjacent to the drive lug 304.

Figure 7:
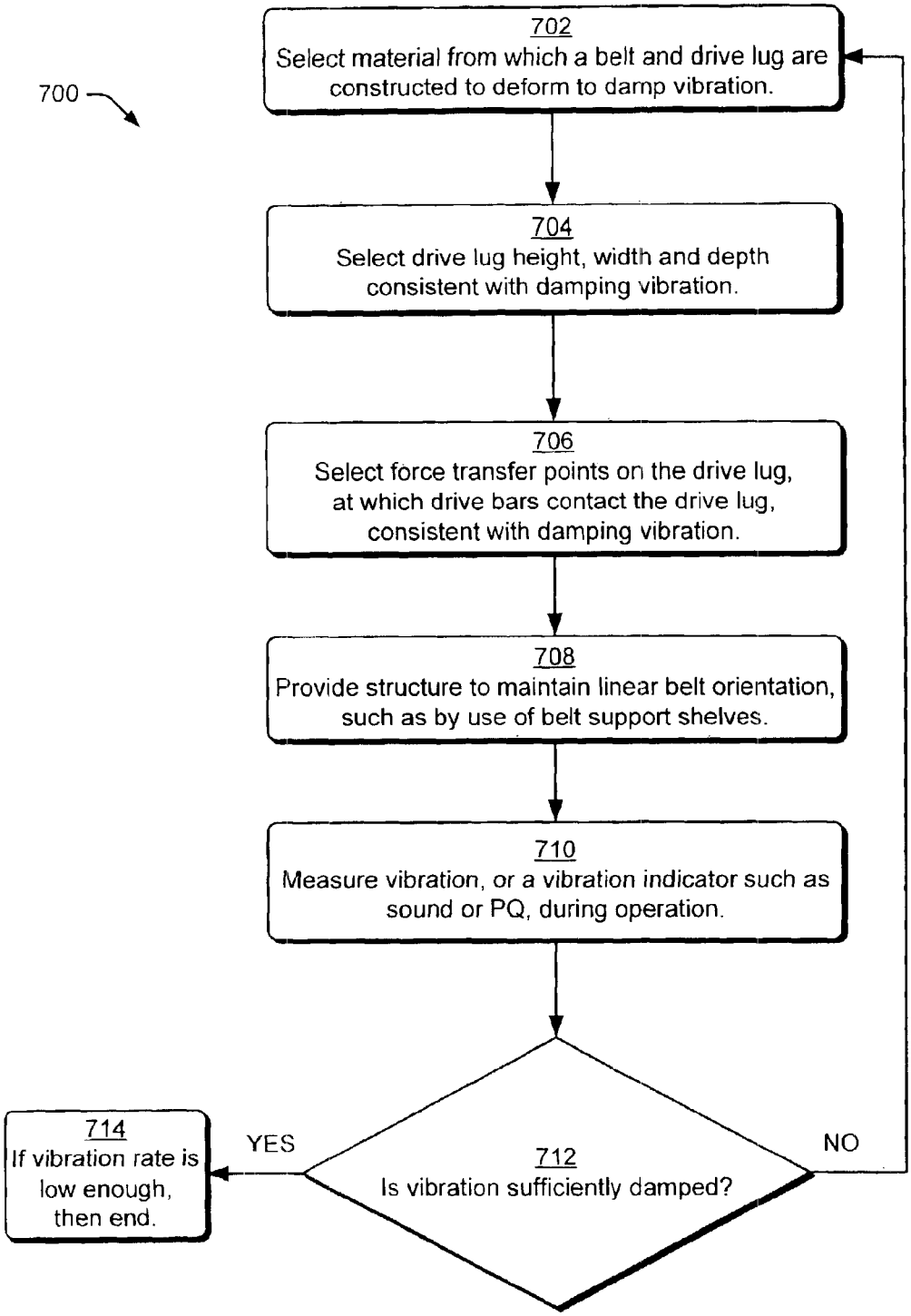
FIG. 7 is a flow diagram describing a method to design a compliant belt attach according to an embodiment of the present invention.

The flow chart of FIG. 7 illustrates an implementation of an exemplary method 700 for the design of a compliant belt attach. The elements of the method may be performed by any desired means, such as by the execution of processor-readable instructions defined on a processor-readable media, such as a disk, a ROM or other memory device. Such media may be associated, for example, with an automated design system. Also, actions described in any block may be performed in parallel with actions described in other blocks, may occur in an alternate order, or may be distributed in a manner which associates actions with more than one other block.

At block 702, the material from which the drive belt 112 and drive lug 304 is to be built is selected. In one embodiment, the drive belt 112 and drive lug 304 are constructed in a one-piece manner from the same material. In an alternate embodiment, the drive belt 112 and drive lug 304 are constructed separately and then assembled together. The material used may include an underlying strength fiber made of Kevlar®, polyester or glass, etc. The strength fiber is encapsulated within a covering of polyurethane, neoprene, ethylene, flourosilicone, nitrile, butyl or silicone, etc. The selection is made to result in a drive belt 112 with a drive lug 304 that will deform to damp vibration, such as in a manner similar to that illustrated in FIGS. 6A–C. The selection may be aided by the use of material ratings, such as rubber hardness ratings measured by a durometer. In general, selection of too stiff a material results in failure to adequately control problems related to unwanted vibration, while selection of too flexible a material results in problems related to controlling the exact location of the carriage 102 at any particular time.

At block 704, the drive lug 304 height, width and depth are selected for a given application in a manner which is consistent with damping vibration. For example, increasing the vertical height of the drive lug 304 may result in a less rigid drive lug 304, and therefore allow the drive lug 304 to absorb shock energy somewhat more easily. Increasing the width may result in increased rigidity, and thus result in a less flexible drive lug which is more responsive to moving the carriage 102, but less able to absorb shock energy. These factors can be balanced, to provide an overall best mix in any application, and to thereby better control the movement of the carriage and also to better damp vibration during such movements. Additionally, the thickness T (labeled in FIG. 3A) of the drive belt 112 and drive lug 304 may be selected to provide the desired strength and rigidity. Blocks 702 and 704 operate in concert, in that selections made in one block will influence selections made in the other block. For example, the dimensions of the drive lug 304 may depend on the material from which it is constructed. Accordingly, blocks 702 and 704 may be performed simultaneously or in an iterative manner.

At block 706, force transfer points on the drive lug 304 are selected in a manner consistent with damping vibration. Selecting force transfer points involves selecting locations for the drive bars 310, 312, and thereby selecting the specific location on the drive lug 304 which contacts the belt attach 302. Thus, the drive bars 310, 312 may be moved in either of the directions indicated by axis 602 in FIG. 6B which is oriented perpendicularly from the drive belt 112. In the embodiment of FIG. 6, the first and second drive bars 310, 312 are equally distant from the drive belt 112. Note that by selecting force transfer points on the drive lug 304 that are near the drive belt 112 (the up direction of axis 602), the drive lug 304 will be less inclined to deform to absorb shock energy; however, the drive lug 304 may more accurately position the carriage 102. Conversely, by locating the drive bars 310, 312 to contact locations on the drive lug 304 more distant from the drive belt 112 (the down direction of axis 602), the drive lug 304 will better absorb energy; however a small amount of accuracy in positioning the carriage 102 may be lost.

At block 708, a structure is provided to maintain the orientation of the linear drive belt 112. For example, the support shelves 502, 504 and the retainer clip 306 support the drive belt 112, and prevent the drive belt 112 from twisting, arching or otherwise changing configuration during operation.

At block 710, vibration, or a vibration indicator such as sound or print quality, is measured during test operation. The level of vibration must be maintained at, or lower than, a threshold value that may vary according to the project or application.

At block 712, it is determined if the damping performed by the compliant belt attach assembly 208 is sufficient. If so, at block 714 the design process 700 is concluded. If not, some or all of the blocks may be repeated.

Figure 8:
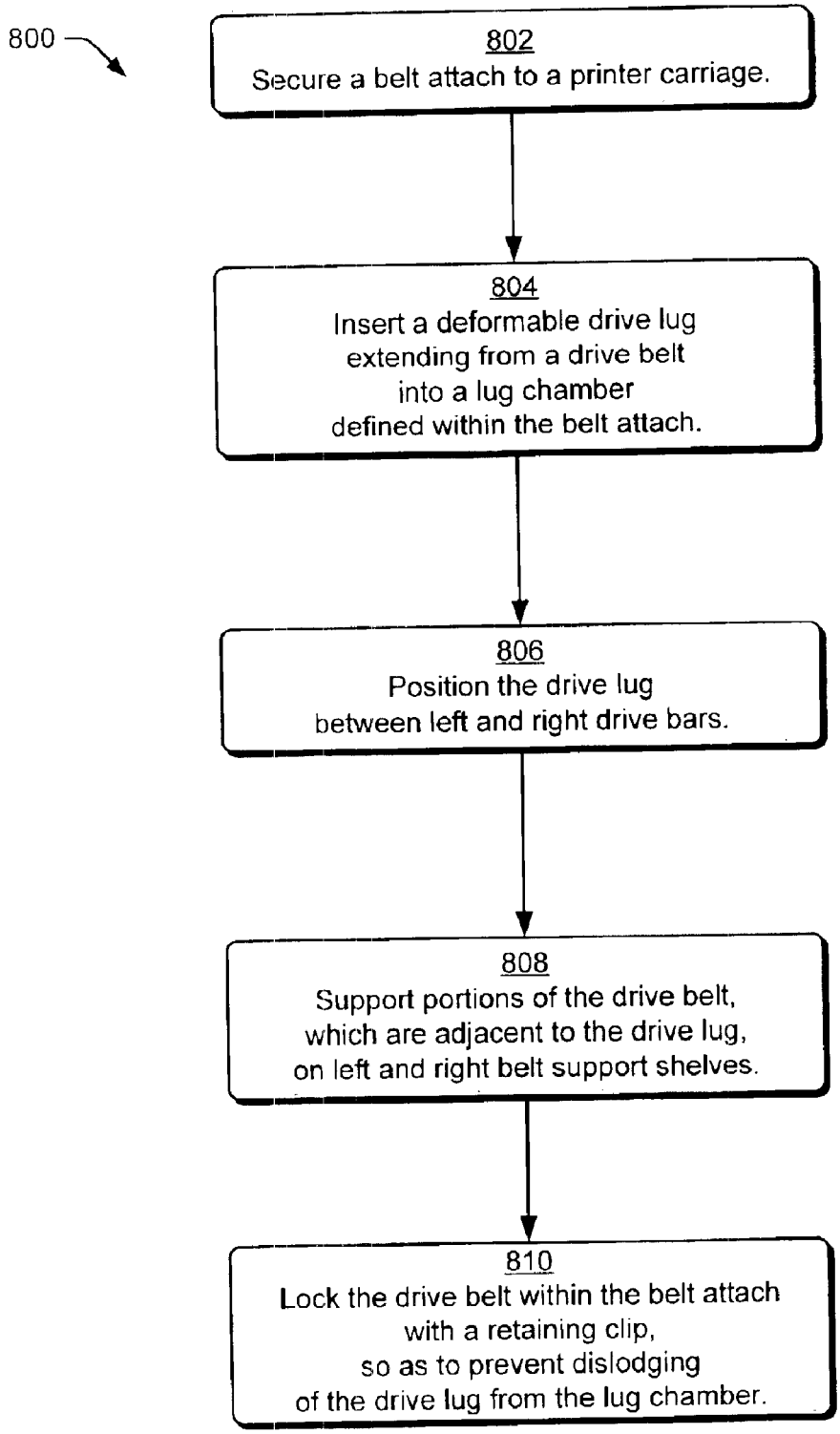
FIG. 8 is a flow diagram describing a method to assemble a compliant belt attach according to an embodiment of the present invention.

The flow chart of FIG. 8 illustrates a further implementation of an exemplary method 800 for assembly of a compliant belt attach. The elements of the method may be performed by any desired means, such as by the execution of processor-readable instructions defined on a processor-readable media, such as a disk, a ROM or other memory device. Such media may be associated, for example, with an automated manufacturing system. Also, actions described in any block may be performed in parallel with actions described in other blocks, may occur in an alternate order, or may be distributed in a manner which associates actions with more than one other block.

At block 802, a belt attach 208 is secured to the carriage 102 of a printer 100.

At block 804, a deformable drive lug 304 extending from a drive belt 112 is inserted into a lug chamber 308 defined in a belt attach portion 302 of the belt attach 208.

At block 806, the drive lug 304 is positioned between left and right drive bars 310, 312. The drive bars 310, 312 should be positioned so that the desired amount of energy is absorbed by the drive lug 304 during operation.

At block 808, portions of the drive belt 112 adjacent to the drive lug 304 are supported on left and right belt support shelves 502, 504.

At block 810, the drive belt 112 is locked to the belt attach 208 with a retaining clip 306 in a manner that allows deformation of the drive lug 304 and prevents dislodging of the drive lug 304 from the drive lug chamber 308. The belt attach 208 is then fully assembled.

Figure 9:
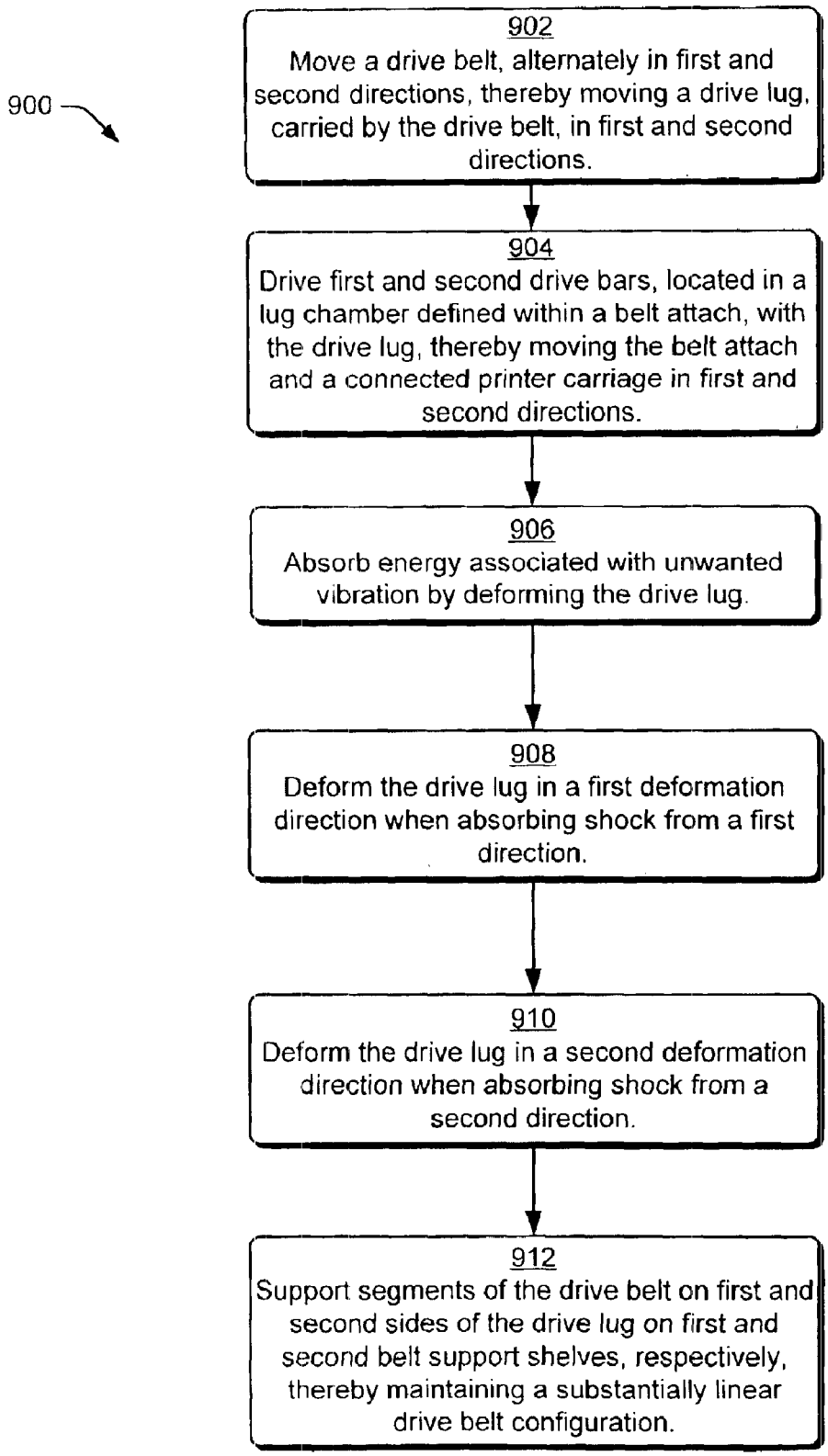
FIG. 9 is a flow diagram describing a method to operate a compliant belt attach according to an embodiment of the present invention.

The flow chart of FIG. 9 illustrates a further implementation of an exemplary method 900 for operation of a compliant belt attach. The elements of the method may be performed by any desired means, such as by the execution of processor-readable instructions defined on a processor-readable media, such as a disk, a ROM or other memory device. Such media is typically associated, for example, with a printer in which the compliant belt attach assembly is installed. Also, actions described in any block may be performed in parallel with actions described in other blocks, may occur in an alternate order, or may be distributed in a manner which associates actions with more than one other block.

At block 902, a drive lug 304 carried by a drive belt 112 is moved in a reciprocating manner between in first and second directions.

At block 904, first and second drive bars 310, 312, located in a lug chamber 308 defined within a belt attach 208, are driven with the drive lug 304, thereby moving the belt attach 208 and a connected printer carriage 102 in the first and second directions.

At block 906, during operation, energy associated with unwanted vibration is absorbed by deforming the drive lug 304.

At block 908, in a manner similar to that illustrated by FIG. 6A, the drive lug 304 is deformed in a first deformation direction when absorbing shock from a first direction D1 (seen in FIG. 6A). At block 910, in a manner similar to that illustrated in FIG. 6C, the drive lug 304 is deformed in a second deformation direction when absorbing shock from a second direction D2 (seen in FIG. 6C).

At block 912, segments of the drive belt 112 on opposed sides of the drive lug 304 are supported on at least one belt support shelf 502 to maintain a linear configuration of the drive belt 112 during deformation of the drive lug 304. As seen in FIGS. 2–6, left and right support shelves 502, 504 may be used.

Although the disclosure has been described in language specific to structural features and/or methodological steps, it is to be understood that the appended claims are not limited to the specific features or steps described. Rather, the specific features and steps are exemplary forms of implementing this disclosure.

What is claimed is:

1. A compliant belt attach assembly, comprising:

a printer carriage;

a belt attach coupled to the printer carriage and defining a lug chamber; and first and second drive bars carried by the belt attach and configured to contact opposing first and second sides of a drive lug of a drive belt to allow drive lug deformation in response to vibration transmitted by the drive belt.

2. The compliant belt attach assembly of claim 1, additionally comprising:

first and second belt support shelves, configured to support portions of the drive belt on opposed sides of the drive lug.

3. The compliant belt attach assembly of claim 1, additionally comprising:

a fastener housing configured to allow attachment of the belt attach to the drive belt.

4. The compliant belt attach assembly of claim 1, wherein the lug chamber is sized to allow the drive lug deformation when the drive lug is applying force to either of the first and second drive bars.

5. The compliant belt attach assembly of claim 1, wherein the first and second drive bars contact first and second locations on the drive lug which are equally distant from the drive belt.

6. The compliant belt attach assembly of claim 1, additionally comprising:

a retaining clip, configured to secure the drive lug of the drive belt in the lug chamber.

7. The complaint belt attach assembly of claim 6, wherein the retaining clip comprises flexible fastening flanges configured to engage the belt attach in a releasable manner.

8. The compliant belt attach assembly of claim 6, wherein the retaining clip defines notches configured to fit around the drive bars to allow clip attachment without contact to the drive bars.

9. The compliant belt attach assembly of claim 1, wherein the lug chamber has first and second opposite sides, wherein the first and second drive bars project from the first and second sides of the lug chamber, respectively, and wherein the drive bars are configured to contact opposing first and second sides of the drive lug of the drive belt to space the first and second sides of the drive lug from the first and second sides of the lug chamber, respectively, so as to allow drive lug deformation.

10. A printer, comprising:

a carriage;

a compliant belt attach assembly, comprising:

a belt attach comprising a fastener to connect the belt attach to the carriage;

a belt assembly including a drive lug configured for confinement within a lug chamber defined in the belt attach;

first and second drive bars in the lug chamber, aligned for contact with first and second sides of the drive lug to produce drive lug deformation to damp vibration.

11. The printer of claim 10, wherein the belt attach further comprises:

first and second belt support shelves to support portions of the belt assembly adjacent to the drive lug.

12. The printer of claim 10, additionally comprising:

a retaining clip, configured to connect the belt attach to prevent the drive lug from exiting the lug chamber.

13. A method of assembling a compliant belt attach, comprising:

inserting a deformable drive lug, extending from a drive belt, into a lug chamber defined within a belt attach coupled to a printer carriage;

positioning the drive lug between left and right drive bars; and wherein the lug chamber, drive lug, and drive bars, are selected so that the drive lug flexes within the lug chamber, thereby damping vibration but without resulting in sluggish response.

14. The method of claim 13, additionally comprising:

supporting portions of the drive belt which are adjacent to the drive lug on left and right belt support shelves.

15. The method of claim 13, additionally comprising:

locking the drive belt within the belt attach with a retaining clip.

16. The method of claim 13, wherein the lug chamber within the belt attach has first and second opposite sides and wherein the drive lug is positioned between left and right drive bars projecting from the first and second opposite sides to space first and second sides of the drive lug from the first and second sides of the lug chamber, respectively.

17. A compliant belt attach assembly for a printer comprising:

means for moving a drive belt, alternately in first and second directions, thereby moving a drive lug, carried by the drive belt, in the first and second directions;

means for driving first and second drive bars, located in a lug chamber defined within a belt attach, with the drive lug, thereby moving the belt attach and a connected printer carriage in the first and second directions; and means for absorbing energy associated with unwanted vibration by deforming the drive lug with at least one of the first and second drive bars.

18. A compliant belt attach assembly for a printer as recited in claim 17, further comprising:

means for promoting drive lug deformation in a first deformation direction when absorbing shock from the first direction.

19. A compliant belt attach assembly for a printer as recited in claim 17, further comprising:

means for moving the drive belt while segments of the drive belt located on first and second sides of the drive lug are supported on first and second belt support shelves, respectively, so as to maintain a substantially linear drive belt configuration.

* * * * *